US006318462B1

(12) United States Patent
Tessier

(10) Patent No.: US 6,318,462 B1
(45) Date of Patent: Nov. 20, 2001

(54) DOWNHOLE ANTI-ROTATION TOOL

(75) Inventor: Lynn P Tessier, Cochrane (CA)

(73) Assignee: Conelly Financial Ltd., Providenciales (TC)

( * ) Notice: Subject to any disclaimer, the term of this patent is extended or adjusted under 35 U.S.C. 154(b) by 0 days.

(21) Appl. No.: 09/517,555

(22) Filed: Mar. 2, 2000

(30) Foreign Application Priority Data

Mar. 5, 1999 (CA) ..... 2264467

(51) Int. Cl.[7] ..... E21B 23/01
(52) U.S. Cl. ..... 166/206; 166/242.1; 166/243
(58) Field of Search ..... 166/117.7, 206, 166/242.1, 243; 175/73

(56) References Cited

U.S. PATENT DOCUMENTS

| | | | | |
|---|---|---|---|---|
| 1,617,730 | | 2/1927 | Dougherty . | |
| 2,038,262 | | 4/1936 | Bernhardt . | |
| 2,643,859 | * | 6/1953 | Brown | 175/73 |
| 2,665,888 | | 1/1954 | Claypool et al. . | |
| 2,819,039 | * | 1/1958 | Lindsay et al. | 175/73 |
| 3,296,900 | | 1/1967 | Behnke . | |
| 3,322,006 | | 5/1967 | Brown . | |
| 3,380,528 | | 4/1968 | Timmons . | |
| 3,382,929 | * | 5/1968 | Plunk | 166/243 X |
| 4,416,339 | * | 11/1983 | Baker et al. | 175/73 X |
| 4,499,799 | | 2/1985 | Bordages . | |
| 4,669,555 | | 6/1987 | Petree . | |
| 4,739,843 | * | 4/1988 | Burton | 175/73 |
| 4,811,785 | | 3/1989 | Weber . | |
| 4,886,130 | * | 12/1989 | Evans | 175/73 |
| 4,901,793 | | 2/1990 | Weber . | |
| 5,275,239 | | 1/1994 | Obrejanu . | |
| 5,623,991 | | 4/1997 | Jani . | |
| 5,636,690 | * | 6/1997 | Garay | 166/243 X |
| 5,909,770 | * | 6/1999 | Davis | 166/206 X |
| 6,073,693 | * | 6/2000 | Aldridge | 166/217 |

FOREIGN PATENT DOCUMENTS 1274470 9/1990 (CA) .

* cited by examiner

*Primary Examiner*—George Suchfield
(74) *Attorney, Agent, or Firm*—Sean W. Goodwin

(57) ABSTRACT

A tool is provided for preventing the rotation of a downhole tool or rotary pump stator, the tool comprising a tubular housing and a jaw which pivots radially outwardly from the tool upon tool rotation to engage the casing wall for arresting tool rotation and providing significant stabilization of a rotary pump. In doing so, the tool housing moves oppositely to rest against the casing opposite the jaw. The tool housing and the downhole tool are thereby restrained and stabilized by the casing wall. The tool's jaw is released and is stowed adjacent the housing by opposite tool rotation. Preferably the profile of the jaw allows it to stow closely against the housing for presenting minimal obstruction. More preferably, the jaw is formed independent of the housing and the bore supports differential pressure so that the tool can be installed above a rotary pump or as a part of an extended tailpiece.

17 Claims, 4 Drawing Sheets

1
2
3
4
5
7
8
9
10
11
12
13
14
30

DOWNHOLE ANTI-ROTATION TOOL

FIELD OF THE INVENTION

The invention relates to a tool for threading onto and preventing rotation of a tubing string or progressive cavity pump in the bore of a casing string.

BACKGROUND OF THE INVENTION

Oil is often pumped from a subterranean reservoir using a progressive cavity (PC) pump. The stator of the PC pump is threaded onto the bottom of a long assembled string of sectional tubing. A rod string extends downhole and drives the PC pump rotor. Large reaction or rotor rotational forces can cause the tubing or PC pump stator to unthread, resulting in loss of the pump or tubing string.

Anti-rotation tools are known including Canadian Patent 1,274,470 to J. L. Weber and U.S. Pat. No. 5,275,239 to M. Obrejanu. These tools use a plurality of moving components, slips and springs to anchor and centralize the PC Pump stator in the well casing.

Further, the eccentric rotation of the PC Pump rotor imposes cyclical. motion of the PC Pump stator, which in many cases is supported or restrained solely by the tool's slips. Occasionally a stabilizing tool is added to dampen or restrain the cyclical motion to failure of the anti-rotation tool.

SUMMARY OF THE INVENTION

A simplified anti-rotation tool is provided, having only one moving part but which both prevents rotation and stabilizes that to which it is connected. In simplistic terms, the tool connects to a PC Pump or other downhole tool and upon rotation in one direction, causes a jaw to pivot radially outwardly from the tool housing to engage the casing wall and to arrest tool rotation. This action causes the tool housing to move oppositely and come to rest against the casing opposing the jaw. The tool housing and the downhole tool are thereby restrained and stabilized by the casing wall.

In a broad apparatus aspect, an anti-rotation tool comprises: a tubular housing having a bore and having at least one end for connection to a downhole tool and a jaw having a hinge and a radial tip, the jaw being pivoted at its hinge from one side of the housing, the jaw's pivot being offset from the jaw's center of gravity so that the jaw is pivotable upon rotation of the tool between a first position stowed against the housing for permitting movement within the casing, and a second position wherein the radial tip swings outwardly from the housing to engage the casing for arresting tool rotation and forcing the housing against the casing opposite the jaw.

Preferably, the profile of the jaw and the profile of the tubular housing are complementary so that the jaw does not project significantly from the housing during movement. Preferably, the jaw is arranged for tools having normal threaded connections wherein the jaw is actuated to the stowed position by counter-clockwise rotation of the tool and to the casing-engaging position by clockwise rotation of the tool.

More preferably, the jaw is formed separately from the housing so that the housing and bore remain independent and the bore can conduct fluid.

DETAILED DESCRIPTION OF THE PREFERRED EMBODIMENT

Figures 1A, 1B, 1C, 2:
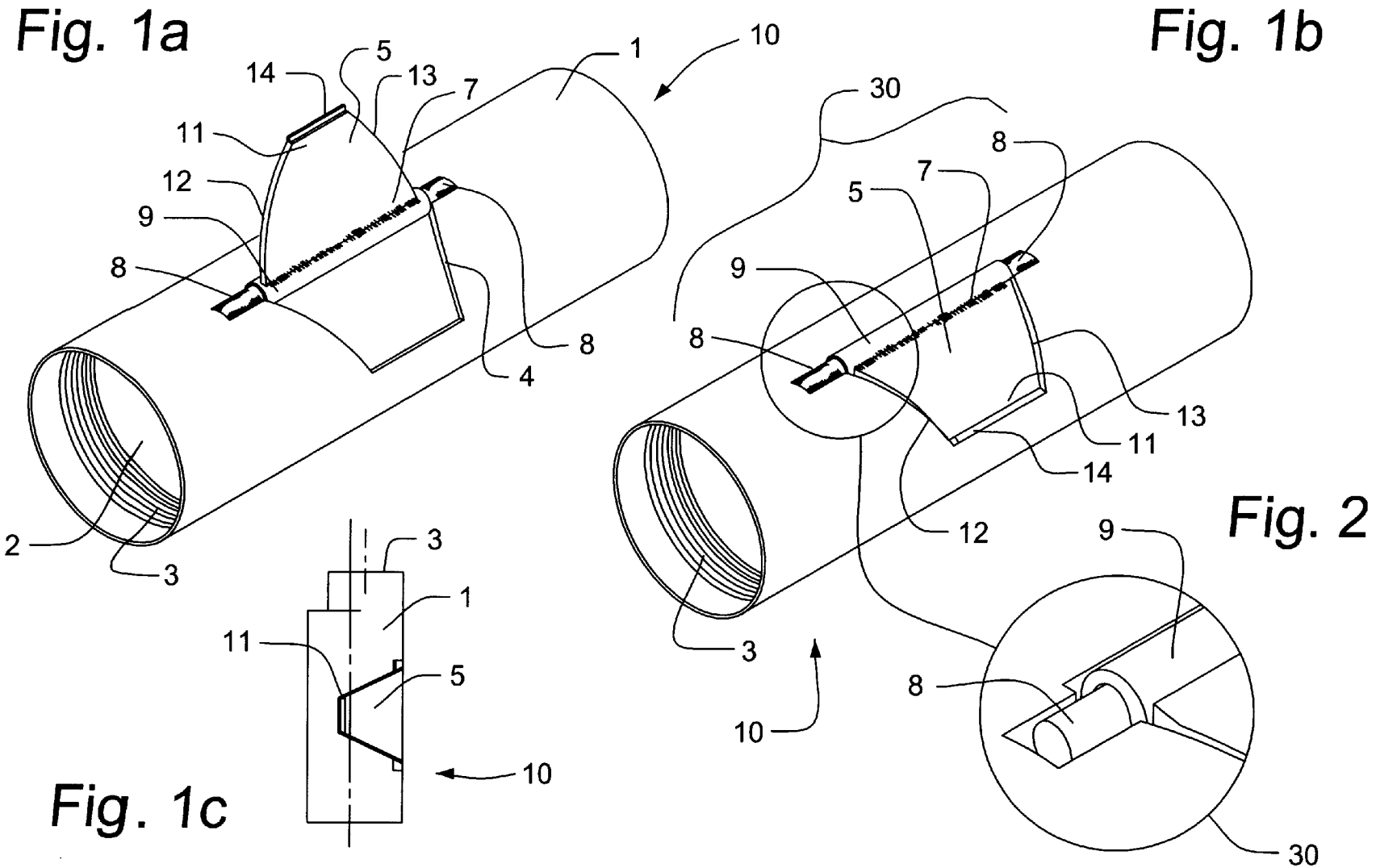
FIGS. 1*a,* 1*b* are an isometric views of one embodiment of the tool showing the jaw with its radial tip in its extended position (FIG. 1*a*) and the stored position (FIG. 1*b*)
FIG. 1*c* is a side view of an optional housing embodiment in which the threaded portion has its center offset from the housing center.
FIG. 2 is an enlarged view of the hinge pin, inset into the housing before welding to the housing.

Having reference generally to Figs. 1*a,* 1*b,* 5*a,* and 5*b,* a tool 10 is provided for preventing rotation relative to casing 6 in a wellbore. The tool 10 comprises a tubular housing 1 with a bore 2. The bore 2 has at least one threaded end 3 for connection to a downhole tool such as the bottom of a PC pump (not shown). A jaw 5 is pivotably mounted to the housing 1 and swings between a stowed position (FIGS. 1*b,* 5*b*) and a casing-engaging position (FIGS. 1*a,* 5*a*).

In a first embodiment, as illustrated in FIGS. 1*a*–3*b,* the jaw 5 pivots out of the housing, interrupting the housing and opening the wellbore. As a variation of the first embodiment, a second embodiment demonstrates a specialized housing which centralizes the bore in the wellbore as illustrated in FIG. 1*c*. In a third embodiment, an alternate arrangement of the jaw is shown which does not compromise the tool's housing or bore.

More particularly, in the first embodiment and having reference to FIGS. 1*a,* 1*b,* 3*a* and 3*b* a portion of the housing wall 4 is cut through to the bore 2 to form a trapezoidal flap or jaw 5. The jaw 5 has an arcuate profile, as viewed in cross-section, which corresponds to the curvature of the housing wall 4. Accordingly, when stowed, the jaw 5 projects minimally from the tubular housing 1 and avoids interfering with obstructions while running into the casing 6 (FIG. 3*b*).

Referring to FIGS. 1*a*–2, the jaw 5 is pivoted to the housing 1 along a circumferential edge 7 at hinge 30. The jaw 5 has a radial tip edge 11.

Hinge 30 comprises tubing 9 welded to the hinge edge 7 with a pin 8 inserted therethrough. Pin 8 is welded to the housing wall 4 at its ends. In a mirrored and optional arrangement (not shown), the jaw's hinge edge 7 has axially projecting pins and the housing wall is formed with two corresponding and small tubular sockets for pinning the pins to the housing and permitting free rotation of the jaw therefrom.

The hinge edge 7 and hinge 30 are formed flush with the tubular housing wall 4.

The running in and tripping out of the tool 10 is improved by using a trapezoidal jaw 5, formed by sloping the top and bottom edges 12,13 of the jaw 5. The hinge edge 7 is longer than the radial tip edge 11. Accordingly, should the radial tip 11 swing out during running in or tripping out of the tool 10, then incidental contact of the angled bottom or top edges 12,13 with an obstruction causes the jaw 5 to rotate to the stowed and non-interfering position.

The jaw's radial tip 11 can have a carbide tip insert 14 for improved bite into the casing 6 when actuated.

If the wall thickness of the jaw 5, typically formed of the tubular housing wall 4, is insufficient to withstand the anchoring stress, then a strengthening member 15 can be fastened across the chord of the radial tip 11 to the hinge edge 7.

Figure 3A:
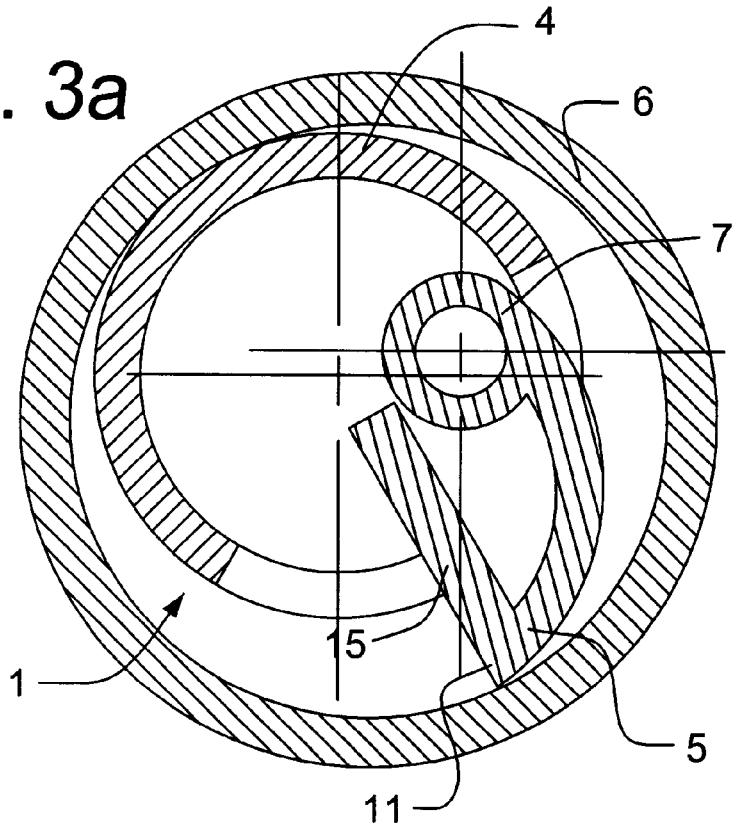
FIGS. 3*a* and 3*b* are cross sectional views of the tool through the hinge, illustrating the jaw open and engaging the casing (FIG. 3*a*) and closed for installation (FIG. 3*b*)
Figure 3B:
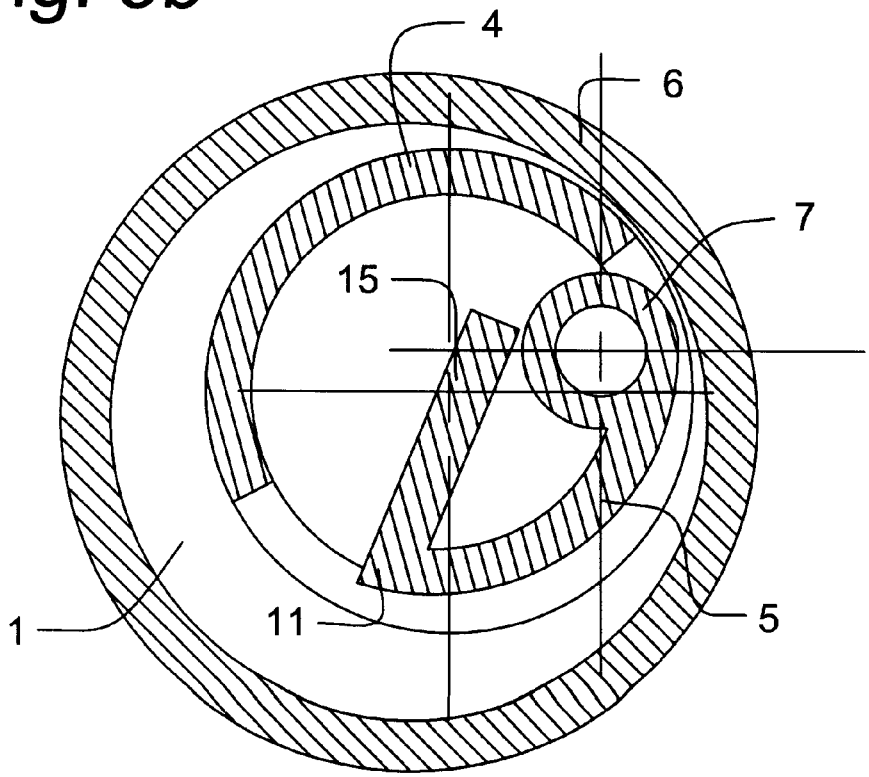

The strengthening member 15 can include, as shown in FIGS. 3*a,* 3*b,* a piece of tool steel or the equivalent which substitutes for the carbide insert.

In operation, the tool 10 is set by clockwise rotation so that the jaw 5 rotates out as an inertial response and is released simply by using counter-clockwise rotation. Specifically, as shown in FIG. 3*b,* when the tool is rotated counter-clockwise as viewed from the top, the jaw's radial tip edge 11 rotates radially inwardly and becomes stowed flush with the housing wall 4, minimizing the width or effective diameter of the tool 10. Conversely, as shown in FIG. 3*a,* when the tool 1 is rotated clockwise as viewed from the top, the jaw 5 rotates radially outwardly from the housing 1, increasing the effective diameter of the tool 10, and the radial tip engages the casing 6. Further, the housing 1 is caused to move in an opposing manner and also engages the casing 6 opposite the jaw 5, the effective diameter being greater than the diameter of the casing 6.

Significant advantage is achieved by the causing the tool's housing 1 and its associated downhole tool (PC Pump) to rest against the casing 6. The casing-engaged jaw 5 creates a strong anchoring force which firmly presses the tool housing 1 and the PC Pump stator into the casing 6. Accordingly, lateral movement of the PC Pump is restricted, stabilizing the PC Pump's stator against movement caused by the eccentric movement of its rotor. It has been determined that the stabilizing characteristic of the tool 10 can obviate the requirement for secondary stabilizing means.

Referring back to FIG. 1*c,* in an optional second embodiment, the threaded end 3 can be formed off-center to the axis of the housing 1, so that when the radial tip 11 engages the casing 6, the axis of the threaded end 3 is closer to the center of the casing 6 than is the axis of the housing 1. This option is useful if the PC Pump or other downhole tool requires centralization.

In the first and second embodiment, the jaw 5 is conveniently formed of the housing wall 4, however, this also opens the bore 2 to the wellbore. If the tool 10 threaded to the bottom of a PC Pump, this opening of the bore 2 is usually irrelevant. However, where the bore 2 must support differential pressure, such as when the PC Pump suction is through a long fluid conducting tailpiece, or the tool 10 is secured to the top of the PC Pump and must pass pressurized fluids, the bore 2 must remain sealed.

Figure 4:
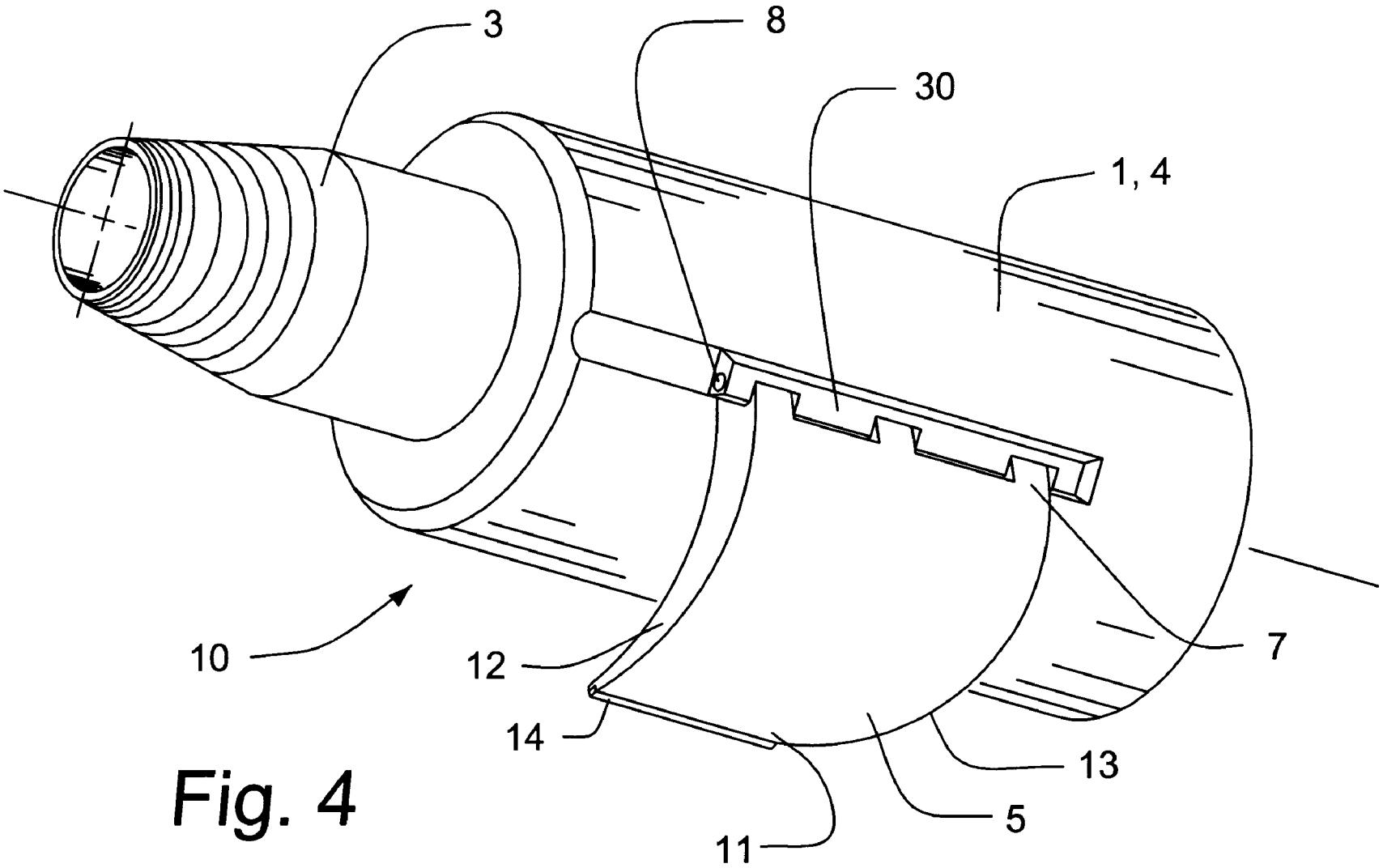
FIG. 4 is an isometric view of a third embodiment of the tool showing the jaw with its radial tip in its extended position.
Figure 5A:
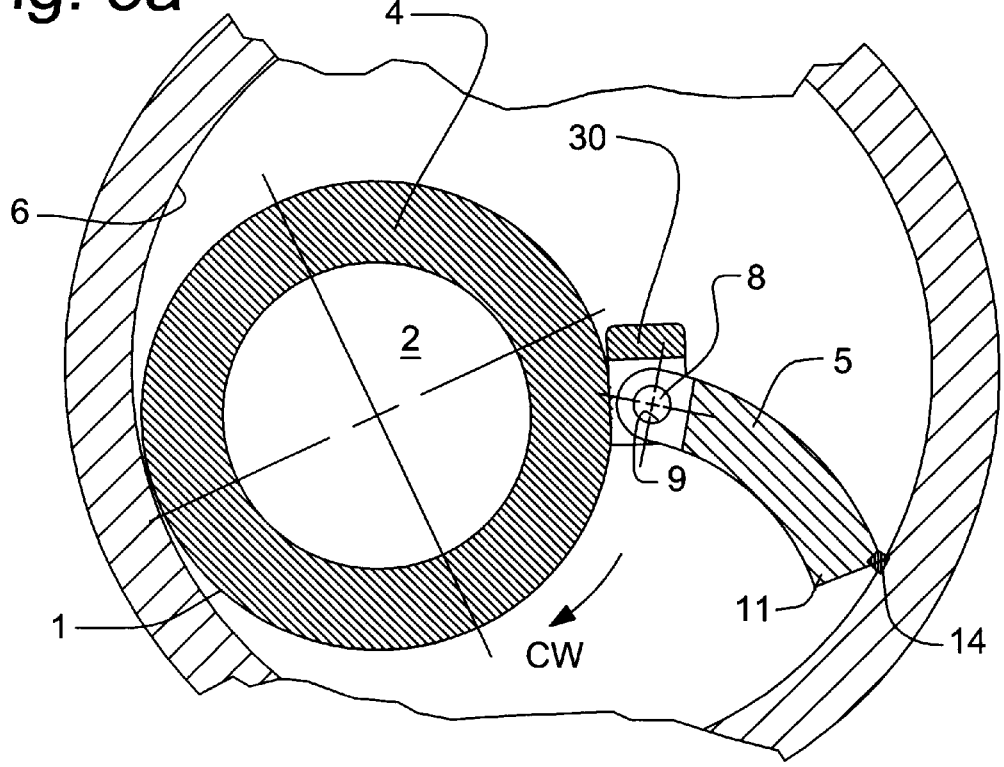
FIGS. 5*a* and 5*b* are cross sectional views of the tool according to FIG. 4, viewed through the hinge with the jaw open and engaging the casing (FIG. 5*a*) and closed for installation (FIG. 5*b*).
Figure 5B:
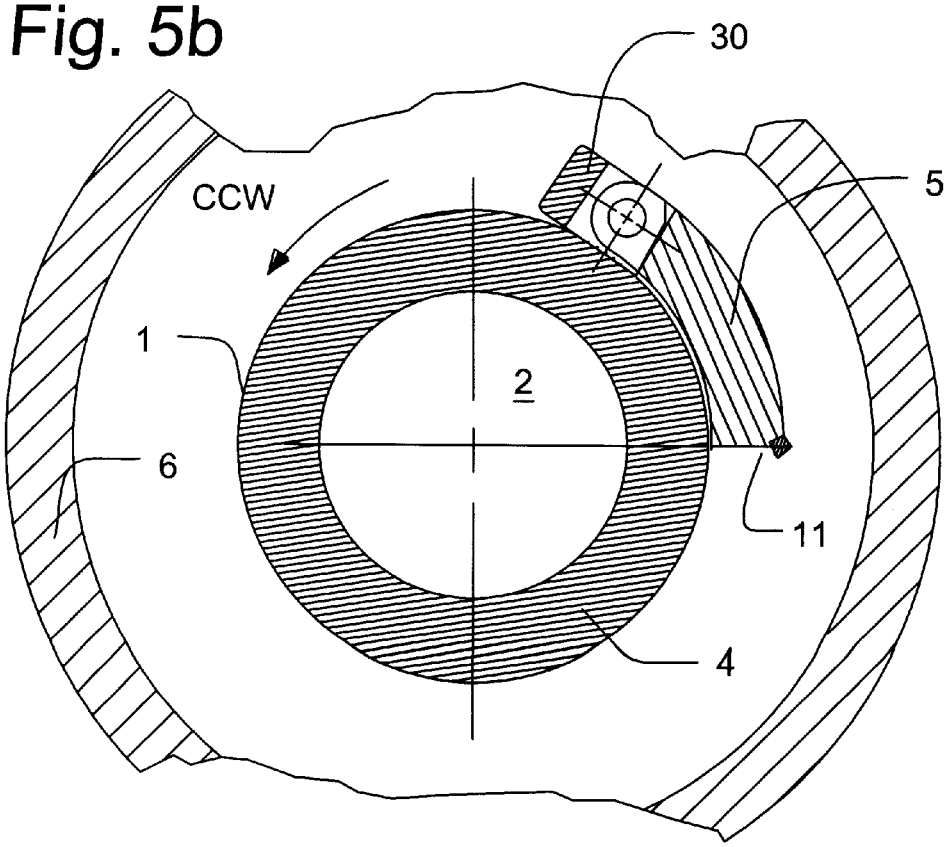

Accordingly, and having reference to FIGS. 4–5*b,* in a third embodiment, the housing wall 4 is not interfered with so that the bore 2 remains separate from the wellbore. This is achieved by mounting the jaw 5 external to the housing 1. The profile of jaw 5 conforms to the housing wall 4 so as to maintain as low a profile as possible when stowed (FIG. 5*b*).

More specifically as shown in FIG. 4, as was the case in the first embodiment, the profile of the jaw 5 corresponds to the profile of the housing wall 4. In this embodiment however, the jaw 5 is pivoted along its circumferential edge 7 at a piano-type hinge 30 mounted external to the housing wall 4. Corresponding sockets 9 are formed through the circumferential edge of the jaw and the hinge 30. Pin 8 is inserted through the sockets 9. A carbide insert 14 is fitted to the radial tip edge 11 of the jaw 5.

In operation, as shown in FIG. 5*a,* if the tool 1 is rotated clockwise as viewed from the top, the radial tip edge 11 of the jaw rotates radially outwardly from the housing and the carbide insert 14 engages the casing 6. The housing wall 4 moves and also engages the casing 6, opposite the jaw 4 for anchoring and stabilizing the tool. As shown in FIGS. 3*a* and 5*a,* the overall dimension of the extended jaw 5 and the housing 1 is greater than the diameter of the casing 6 so that contact of the radial tip edge 11 with the casing 6 forces the housing against the casing opposing the jaw.

As shown in FIG. 5*b,* if the tool is rotated counter-clockwise as viewed from the top, the jaw's radial tip edge 11 rotates radially inwardly and becomes stowed against the housing wall 4.

The embodiment of the invention in which an exclusive property or privilege is claimed are defined as follows:

1. A tool to prevent rotation of a downhole tool suspended in a wellbore casing comprising:

(a) a tubular housing having a wall for engaging the casing and having at least one end for connection to the downhole tool; and (b) a jaw having a radial tip and which is pivoted from a point on the housing opposing the casing engaging wall for varying the effective diameter of the tool, the jaw's pivot being offset from the jaw's center of gravity so that the jaw is pivotable upon rotation of the tool between i) a first position stowed against the housing for minimizing the tool's effective diameter and permitting movement within the casing, and ii) a second casing-engaging position wherein the radial tip pivots outwardly from the housing to increase the tool's effective diameter so that both the radial tip and the housing wall engage the casing for arresting tool rotation.

2. The tool as described in claim 1 wherein jaw has a profile and the tubular housing has a corresponding profile so that when stowed, the jaw only projects minimally from the housing for minimizing the tool's effective diameter.

3. The tool as described in claim 1 wherein the radial tip of the jaw is located clockwise from the hinge so that the jaw is actuated:

(a) to the stowed position by counter-clockwise rotation of the tool; and (b) to the casing-engaging position by clockwise rotation of the tool.

4. A tool to prevent rotation of a downhole tool suspended in a wellbore casing comprising:

(a) a tubular housing having a bore and having at least one end for connection to the downhole tool; and (b) a jaw having a hinge and a radial tip, the jaw being pivoted at its hinge from one side of the housing, the jaw's pivot being offset from the jaw's center of gravity so that the jaw is pivotable upon rotation of the tool between a first position stowed against the housing for permitting movement within the casing, and a second position wherein the radial tip swings outwardly from the housing to engage the casing for arresting tool rotation and forcing the housing against the casing opposite the jaw, the jaw having a profile and the tubular housing having a corresponding profile so that when stowed, the jaw only projects minimally from the housing, the jaw further being trapezoidal in shape having sloped top and bottom edges so that the jaw is caused to rotate to the stowed position if contacted with an obstruction in the wellbore during running in and tripping out.

5. The tool as described in claim 4 wherein the jaw is recessed within the housing when in the stowed position.

6. The tool as described in claim 5 wherein the jaw is supported to withstand anchoring stress by the addition of a strengthening member.

7. The tool as described in claim 6 wherein the strengthening member is a piece of tool steel.

8. The tool as described in claim 5 wherein the radial tip has an insert to improve bite into the casing when in the casing-engaging position.

9. The tool as described in claim 2 wherein:

(a) the housing has a bore which is maintained separate from the wellbore; and (b) the jaw rests against the tubular housing when in the stowed position.

10. The tool as described in claim 9 wherein the jaw is trapezoidal in shape having sloped top and bottom edges so that the jaw is caused to rotate to the stowed position if contacted with an obstruction in the wellbore during tripping in and tripping out.

11. The tool as described in claim 9 wherein the radial tip has an insert to improve bite into the casing when in the casing-engaging position.

12. The tool as described in claim 1 wherein the jaw is trapezoidal in shape having sloped top and bottom edges so that the jaw is caused to rotate to the stowed position if contacted with an obstruction in the wellbore during running in and tripping out.

13. The tool as described in claim 12 wherein the jaw is recessed within the housing when in the stowed position.

14. The tool as described in claim 13 wherein the radial tip has an insert to improve bite into the casing when in the casing-engaging position.

15. The tool as described in claim 1 wherein:

(a) the housing has a bore which is maintained separate from the wellbore; and (b) the jaw rests against the tubular housing when in the stowed position.

16. A tool for stabilizing a downhole tool suspended in a wellbore casing comprising:

(a) a tubular housing having a wall for engaging the casing and having at least one end for connection to the downhole tool; and (b) a jaw having a radial tip and which is pivoted from a point on the housing opposing the casing engaging wall for varying the effective diameter of the tool, the jaw's pivot being offset from the jaw's center of gravity so that the jaw is pivotable upon rotation of the tool between (i) a first position stowed against the housing for minimizing the tool's effective diameter and permitting movement within the casing, and (ii) a second casing-engaging position wherein the radial tip pivots outwardly from the housing to increase the tool's effective diameter so that both the radial tip and the housing wall engage the casing, wherein the engagement of housing wall and the casing stabilizing the tool and the downhole tool.

17. The tool as described in claim 16 wherein the jaw is trapezoidal in shape having sloped top and bottom edges so that the jaw is caused to rotate to the stowed position if contacted with an obstruction in the wellbore during running in and tripping out.

* * * * *